US006009578A

United States Patent [19]

Davis

[11] Patent Number: 6,009,578

[45] Date of Patent: Jan. 4, 2000

[54] SEAT CUSHION

[76] Inventor: Steve Davis, 17361 Lake Iris Ave., Baton Rouge, La. 70817

[21] Appl. No.: 09/168,712

[22] Filed: Oct. 8, 1998

[51] Int. Cl.[7] ..... A47C 20/02

[52] U.S. Cl. ..... 5/653; 5/654; 297/219.1; 297/452.31

[58] Field of Search ..... 5/653, 654, 655.5; 297/452.21, 452.27, 219.1

[56] References Cited

U.S. PATENT DOCUMENTS

| | | | |
|---|---|---|---|
| 4,660,238 | 4/1987 | Jay | 5/654 |
| 5,079,790 | 1/1992 | Pouch | 5/653 X |
| 5,189,747 | 3/1993 | Mundy et al. | 297/452.27 X |
| 5,352,023 | 10/1994 | Jay et al. | 297/452.21 |
| 5,369,829 | 12/1994 | Jay | 5/654 |
| 5,378,045 | 1/1995 | Siekman et al. | 297/452.21 X |
| 5,402,545 | 4/1995 | Jolley | 5/653 |
| 5,426,801 | 6/1995 | Klearman et al. | 5/652 |
| 5,456,519 | 10/1995 | Davis | 297/440.15 |
| 5,459,896 | 10/1995 | Raburn et al. | 5/653 |
| 5,522,106 | 6/1996 | Harrison et al. | 5/653 |
| 5,568,660 | 10/1996 | Raburn et al. | 5/652.1 |
| 5,636,395 | 6/1997 | Serda | 5/655.5 |
| 5,639,145 | 6/1997 | Alderman | 297/452.45 |
| 5,737,788 | 4/1998 | Castellino et al. | 5/654 X |

*Primary Examiner*—Michael F. Trettel
*Attorney, Agent, or Firm*—Joseph N. Breaux

[57] ABSTRACT

A seat cushion comprising a resilient wedge-shaped pad having an upper surface at an incline sloping downwardly from a higher end to a lower end. A plurality of spaced apart gel packs are on the upper surface of the resilient wedge-shaped pad. The gel packs closest to the higher end are of a high density, while other gel packs will decrease in density toward the lower end of the resilient wedge-shaped pad. A waterproof covering is over the resilient wedge-shaped pad and the gel packs to protect the resilient wedge-shaped pad and the gel packs from wear and damage.

10 Claims, 2 Drawing Sheets

SEAT CUSHION

TECHNICAL FIELD

The present invention relates to cushion arrangements and more particularly to a seat cushion. The seat cushion is a device used on the seat of a wheelchair to assist the elderly and those with back or neck problems. The seat cushion performs this function by providing a wedge-shaped pad for comfort and convenience. The seat cushion is a very vital product that saves people money by avoiding hospitalization, buying a new wheelchair, and would make professional's jobs easier.

BACKGROUND ART

Numerous cushion arrangements have been provided in prior art. For example, U.S. Pat. Nos. 5,426,801 to Klearman et al.; 5,456,519 to Davis; 5,459,896 to Raburn et al.; 5,522,106 to Harrison et al.; 5,568,660 to Raburn et al. and 5,639,145 to Alderman all are illustrative of such prior art. While these units may be suitable for the particular purpose to which they address, they would not be as suitable for the purposes of the present invention as heretofore described.

The Klearman et al. U.S. Pat. No. 5,426,801 discloses a custom orthotic bracing system. A chair restraint for supporting a patient in a sitting position from a chair or the like includes an upper torso support member having an orthotic support panel readily removable therefrom. The orthotic support panel is made from a plastic which is readily deformable by a heat gun or the like such that it may be custom fit to surround the patient both from his back and sides to provide lateral support to the patient. The upper torso restraint member includes a pair of straps extending forwardly to wrap around the front of the patient to thereby secure the patient within the upper torso restraint member. A seat cushion member includes a flat panel stiffener to provide a firm base for the patient and an interior cushioning member which is inclined generally rearwardly to thereby cradle the patient within the restraint. A center divider member of cushioning material provides two separately defined areas for receiving the patient's legs. Straps are provided for securing the upper torso restraint member to the seat cushion member, and both of those members independently to the chair frame.

The Davis U.S. Pat. No. 5,456,519 discloses a back cushion and seat cushion system. The back cushion and seat cushion system includes a back cushion comprising a lower section having an inner surface, an outer surface, a bottom edge with opposed side edges, and a raised sacral counter pressure pad disposed thereon, and upper section extended upwards from the lower section. The upper section having an inner surface, an outer surface, a top edge with opposed side edges coupled with the side edges of the lower section, with in inner surface and the side edges thereof bulging outwards to define a curved pillow. A seat cushion comprising a raised outer section for supporting the femurs of a user thereon having an inner surface, an outer surface, and a front edge and opposed side edges extended laterally therefrom. A depressed inner section having an inner surface, an outer surface, a top edge and opposed side edges extended from the top edge and coupled to the side edges of the outer section, and two spaced concave depressions formed thereon defining a saddle.

The Raburn et al. U.S. Pat. No. 5,459,896 discloses a wheelchair cushion and cover. Pressure relief for wheelchair patients is improved by use of a relatively higher density foam, such as 2.4 pounds per cubic foot or above and a 25 percent ILD characteristic of at least about 50 pounds, together with independently acting cube shaped segments. The segments have predetermined respective separation and rounded upper edges with a predetermined radius of curvature which is larger about the periphery of the wheelchair pad. A relatively lowered pad thickness of about 3 inches facilitates patient movement onto and off from a wheelchair cushion. A removable covering of laminated materials is stretchable, so as to slide over the rounded edges of the segments and down into separations therebetween to maintain independent action of such segments during use with the covering. An upper layer of the covering comprises a base layer of woven fabric of elastic synthetic fibers. A lower layer of the covering comprises a water resistant coating of urethane generally at least about 1 mil thick. The stretchable covering features can be used separately with other forms of patient support, such as mattress pads having convolutions or other forms of independent support segments with separations therebetween.

The Harrison et al. U.S. Pat. No. 5,522,106 discloses a seat cushion assembly. The seat cushion assembly has a lower layer of resilient shaped retaining material with an upper surface having a pair of adjacent parallel channel-shaped recesses extending rearwardly from a front end of the cushion assembly and shaped to conform to the undersides of the thighs of a sitting person. The upper surface also has a rear recess in a rearward and intermediate area positioned to be beneath the buttocks of the sitting person. An insert of relatively firm deformable material is located in the rear recess of the lower layer, and an upper layer of soft material covers the lower layer and the insert. The upper layer has channel-shaped recesses conforming with the channel-shaped recesses in the lower layer and a buttock-receiving recess over the insert. The insert serving to accommodate ischial tuberosities of the sitting person and prevents the ishial tuberosities from bottoming out through the cushion assembly. The insert also provides an even distribution of forces over these bony areas.

The Raburn et al. U.S. Pat. No. 5,568,660 discloses a wheelchair cushion and cover. Pressure relief for wheelchair patients is improved by use of a relatively higher density foam, such as 2.4 pounds per cubic foot or above and a 25 percent ILD characteristic of at least about 50 pounds, together with independently acting cube shaped segments. The segments have predetermined respective separation and rounded upper edges with a predetermined radius of curvature which is larger about the periphery of the wheelchair pad. A relatively lowered pad thickness of about 3 inches facilitates patient movement onto and off from a wheelchair cushion. A removable covering of laminated materials is stretchable, so as to slide over the rounded edges of the segments and down into separations therebetween to maintain independent action of such segments during use with the covering. An upper layer of the covering comprises a base layer of woven fabric of elastic synthetic fibers. A lower layer of the covering comprises a water resistant coating of urethane generally at least about 1 mil thick. The stretchable covering features can be used separately with other forms of patient support, such as mattress pads having convolutions or other forms of independent support segments with separations therebetween.

The Alderman U.S. Pat. No. 5,639,145 discloses a portable cushion. The portable flexible cushion disclosed utilizes layers of different foam plastic materials secured together at contacting faces. The cushion combines closed cell and open cell foam plastic material features and a hinged construction providing reversibility and can be used in right angle and flat end to end applications. Optionally, vibrators are received in openings in the panels for therapeutic purposes. Different combinations of the closed and open cell materials are particularly suitable for wet or dry applications.

GENERAL SUMMARY DISCUSSION OF INVENTION

The seat cushion consists of a pad fabricated of a foam material that is cushioning but sturdy, measures approximately eighteen inches by sixteen inches and is wedge-shaped in appearance and construction. The top surface of the wedge-shaped pad incorporates a plurality of cylindrically shaped gel packs, each two inches in diameter. The gel packs are separated in rows according to the density of each gel pack. The gel packs closest to the rear of the wedge-shaped pad in the higher end are high density gel packs. The gel packs decrease in density toward the lower end of the wedge-shaped pad. The entire seat cushion is covered by one single sheet of waterproof material.

A primary object of the present invention is to provide a seat cushion that will overcome the shortcomings of the prior art devices.

Another object is to provide a seat cushion that is a device which would be used on the seat of a wheelchair to assist the elderly and those with back or neck problems, by utilizing a wedge-shaped pad for comfort and convenience.

An additional object is to provide a seat cushion that features many gel filled packs, which would be comfortable and easy to sit on for long periods of time and help prevent a person from sliding off of the wheelchair.

A further object is to provide a seat cushion that is simple and easy to use.

A still further object is to provide a seat cushion that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

Similar reference characters denote corresponding features consistently throughout the attached drawings.

EXEMPLARY MODE FOR CARRYING OUT THE INVENTION

Figure 1:
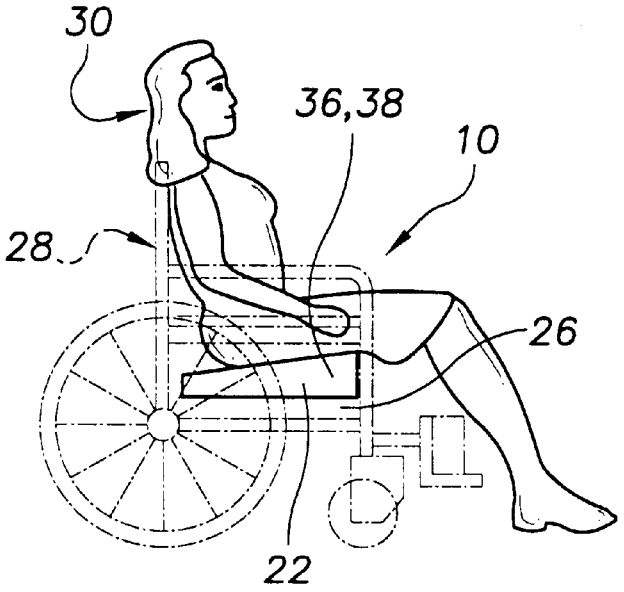
FIG. 1 is a side view of the present invention in use on the seat of a wheelchair, which is shown in phantom.
Figure 2:
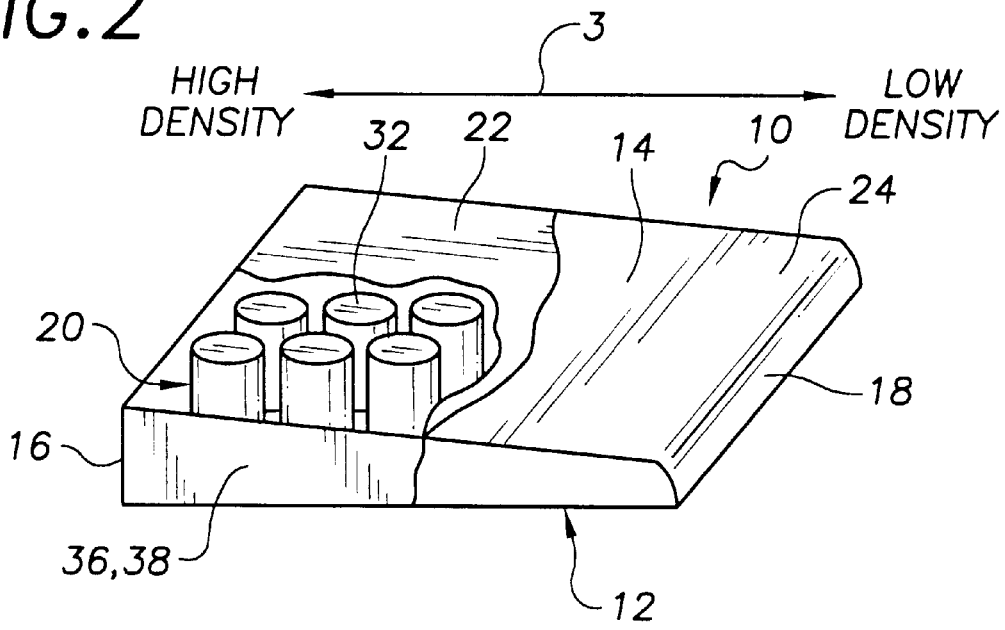
FIG. 2 is a perspective view of the present invention per se with a portion of the covering broken away to show some of the gel packs therein.
Figure 3:
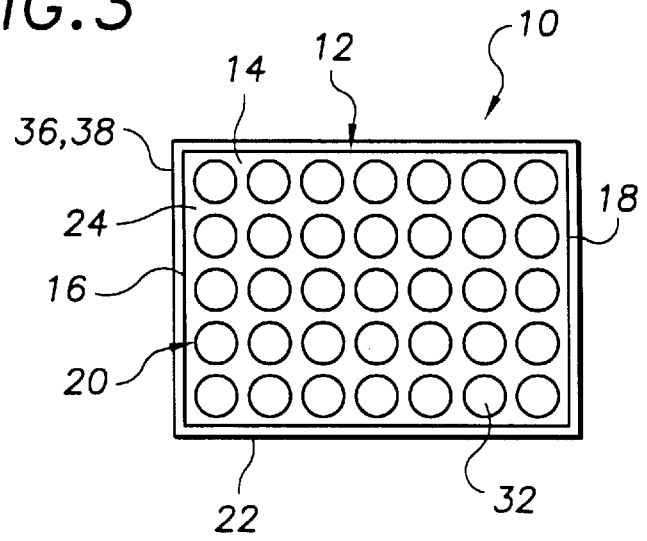
FIG. 3 is a top plan view taken in the direction of arrow 3 in FIG. 2, with a portion of the covering removed therefrom.

Turning now descriptively to the drawings, in which similar reference characters denote similar elements throughout the several views, FIGS. 1 through 3 illustrate the various features of the present invention being a seat cushion 10, comprising a resilient wedge-shaped pad 12 having an upper surface 14 at an incline sloping downwardly from a higher end 16 to a lower end 18. A plurality of spaced apart gel packs 20 are on upper surface 14 of resilient wedge-shaped pad 12. The gel packs 20 closest to higher end 16 are of a high density, while other gel packs 20 will decrease in density toward lower end 18 of resilient wedge-shaped pad 12. A waterproof covering 22 over resilient wedge-shaped pad 12 and gel packs 20, protects resilient wedge-shaped pad 12 and gel packs 20 from wear and damage.

Resilient wedge-shaped pad 12 is fabricated out of a sturdy foam material 24. The sturdy foam material 24 is a low density polyurethane. The resilient wedge-shaped pad 12 measures approximately eighteen inches in length, sixteen inches in width and between two inches to four inches in height, so as to fit upon a seat 26 of a wheelchair 28 and supply comfort to a patient 30 sitting in the wheelchair 28.

Figure 4:
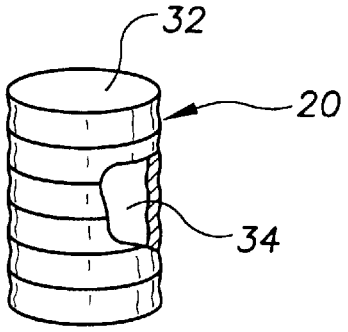
FIG. 4 is a perspective view of one of the gel packs broken away to see the poly-gel material therein.
Figure 5:
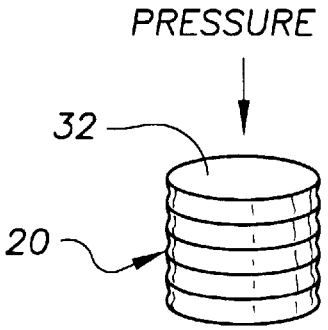
FIG. 5 is a perspective view of one of the gel packs shown under pressure.

Each gel pack 20, as best seen in FIGS. 4 and 5, includes a cylindrically shaped sealed vinyl bag 32, is approximately two inches in diameter and filled with a poly-gel material 34 of variable density. The waterproof covering 22 can be fabricated out of a cloth material 36, and can also be fabricated out of a thin durable plastic material 38.

Resilient wedge-shaped pad 12 is manufactured using an injected foam process. Polyurethane foam is a two-part mix chemical, injected into a wedge-shaped mold. The polyurethane foam will expand and cure quickly to the shape of the wedge-shaped mold, with any channels and contours molded at the same time as one component. A die-cut vinyl manufacturing process using an associated vinyl heat welding process is used to manufacture the gel packs 20, as well as the waterproof covering 22. Poly-gel material 34 is injected into each sealed vinyl bag 32 by an injected needle and then each vinyl bag 32 is resealed.

It can be seen from the preceding description that in use, the patient 30 requiring orthopedic attention would utilize the seat cushion 10 by first having it placed onto the seat 26 of his or her wheelchair 28. The patient 30 would then be seated onto the seat cushion 10, which will allow the gel packs 20 to compress, or flatten. Use of the seat cushion 10 would provide even pressure for seating of those who require wheelchairs 28, while providing comfort to the patient 30.

It is noted that the embodiment of the seat cushion described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A seat cushion comprising:

a resilient wedge-shaped pad having an upper surface with an incline sloping downwardly from a higher end to a lower end;

a plurality of spaced apart gel packs on said upper surface of said resilient wedge-shaped pad, in which said gel packs closest to said higher end are of a first density, while the density of other said gel packs will of decreasing density with respect to said first density in a direction toward said lower end of said resilient wedge-shaped pad; and a waterproof covering over said resilient wedge-shaped pad and said gel packs to protect said resilient wedge-shaped pad and said gel packs from wear and damage.

2. The seat cushion as recited in claim 1, wherein:

said resilient wedge-shaped pad is fabricated out of a sturdy foam material.

3. The seat cushion as recited in claim 2, wherein:

said sturdy foam material is a low density polyurethane.

4. The seat cushion as recited in claim 1, wherein:

said resilient wedge-shaped pad measures approximately eighteen inches in length, sixteen inches in width and between two inches to four inches in height, so as to fit upon a seat of a wheelchair and supply comfort to a patient sitting in said wheelchair.

5. The seat cushion as recited in claim 1, wherein:

each said gel pack includes a cylindrically shaped sealed vinyl bag.

6. The seat cushion as recited in claim 1, wherein:

each said gel pack is approximately two inches in diameter.

7. The seat cushion as recited in claim 1, wherein:

said waterproof covering is fabricated out of a cloth material.

8. The seat cushion as recited in claim 1, wherein:

said waterproof covering is fabricated out of a thin durable plastic material.

9. The seat cushion as recited in claim 1, wherein:

said resilient wedge-shaped pad is manufactured using an injected foam process, in which polyurethane foam being in a two-part mix chemical is injected into a wedge-shaped mold, whereby said polyurethane foam will expand and cure quickly to the shape of said wedge-shaped mold, with any channels and contours molded at the same time as one component.

10. The seat cushion as recited in claim 5, wherein:

a die-cut vinyl manufacturing process using an associated vinyl heat welding process is used to manufacture said gel packs, as well as said waterproof covering, whereby poly-gel material is injected into each said sealed vinyl bag by an injected needle and then each said vinyl bag is resealed.

* * * * *